United States Patent [19]

Goldman et al.

[11] 4,301,429

[45] Nov. 17, 1981

[54] MICROWAVE DIODE WITH HIGH RESISTANCE LAYER

[75] Inventors: Mark B. Goldman, Sudbury; Dana W. Kintigh, Acton; Henri R. Chalifour, Methuen, all of Mass.

[73] Assignee: Raytheon Company, Lexington, Mass.

[21] Appl. No.: 46,595

[22] Filed: Jun. 7, 1979

[51] Int. Cl.[3] ..... H01P 1/15; H01P 3/08

[52] U.S. Cl. ..... 333/22 R; 333/104; 333/247; 357/51; 357/58

[58] Field of Search ..... 333/103, 22 R, 17 M, 333/247, 246, 104; 357/51, 58, 28, 13, 81

[56] References Cited

U.S. PATENT DOCUMENTS 3,219,891 11/1965 Benedict ..... 357/28

3,260,900 7/1966 Shombert ..... 357/28

3,780,322 12/1973 Walters ..... 357/13

4,127,830 11/1978 Chalifour et al. ..... 357/56

*Primary Examiner*—William D. Larkins

*Attorney, Agent, or Firm*—Richard M. Sharkansky; Joseph D. Pannone

[57] ABSTRACT

A microwave diode having an integrally formed fixed resistance layer to provide a monolithic structure. The resistance layer has an approximate value of 50-ohms when the diode is in the forward biased state. The diode in monolithic form is adaptable to be soldered directly to a housing electrically connected to the ground plane of the microstrip circuit. In the reverse bias state the junction capacitance of the structure is small enough, typically 0.02 to 0.05 pf, to isolate the diode from the microstrip circuit thereby minimizing the insertion loss of the device. Packaged varieties of the monolithic structure are applicable to stripline, coaxial and waveguide microwave circuits.

1 Claim, 7 Drawing Figures

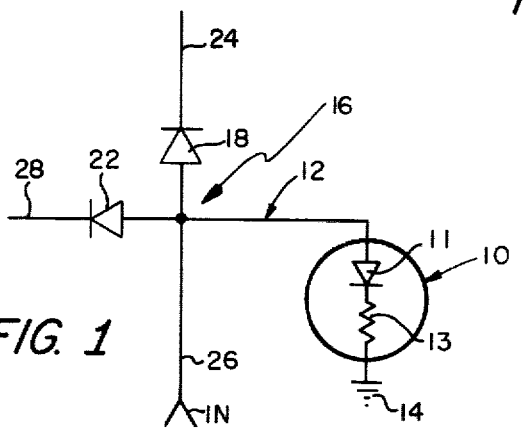
FIG. 1
FIG. 5
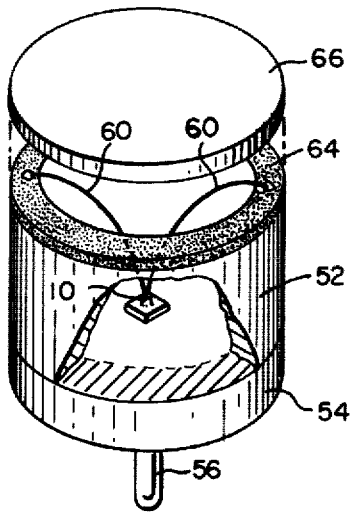
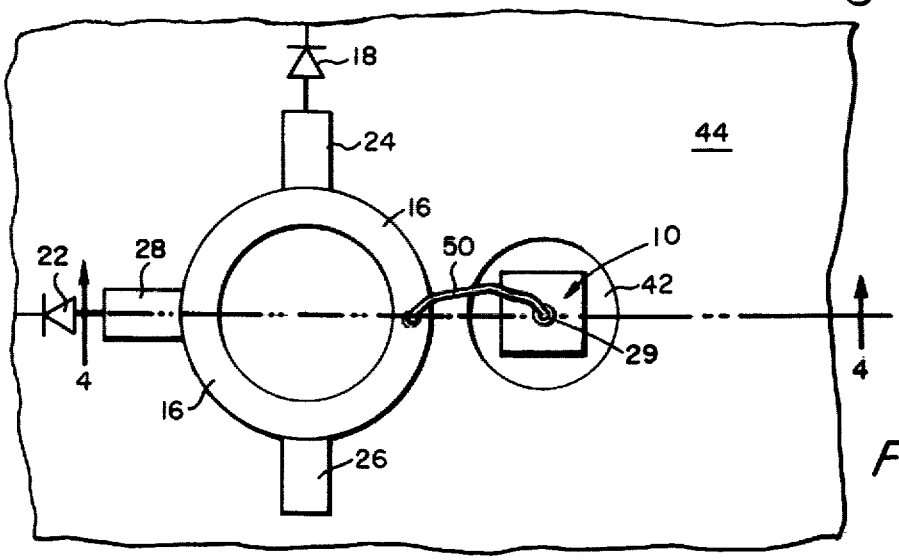
FIG. 3
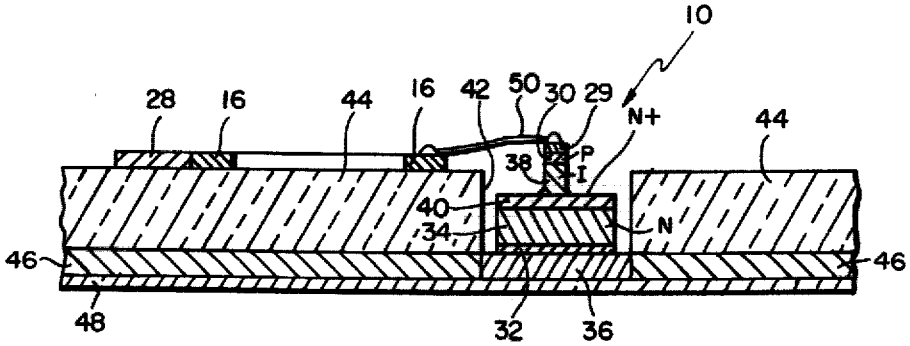
FIG. 4

MICROWAVE DIODE WITH HIGH RESISTANCE LAYER

BACKGROUND OF THE INVENTION

The invention relates generally to diodes and, more particularly, to a microwave diode adapted for use in switched microwave termination circuits.

As is known in the art many microwave devices require that a given port be switched to a matched load. This provides a matched condition for the port when in an isolation state that would otherwise be highly reflective. In the prior art a common technique used to provide such matched load is to have a series diode at the port serially coupled to a termination resistor. This circuit requires the use of individual components including a series diode, termination resistor and a ground strap to interconnect the diode and the resistor along with appropriate thermal compression bonding and/or soldering steps.

Another prior art technique involves the use of a diode connected between the port and ground with the diode driven into the forward bias state by a small current. The amount of current is adjusted such that the diode has a proper resistance value to provide a matched load. With such technique, however, the control of the small current is difficult. Additionally, the current required to provide the proper resistance value may vary from diode to diode making it necessary to customize each device. Still further, a diode partially forward biased is quite temperature sensitive and, consequently, the device may not be properly terminated over a wide range of temperature.

SUMMARY OF THE INVENTION

With this background of the invention in mind, it is therefore an object of this invention to provide an improved microwave termination diode.

This and other objects of the invention are attained generally by providing: A microwave diode having a fixed resistance layer incorporated in an integral structure. In the forward bias state the microwave signal in, for example, a multi-throw diode junction encounters a matched load termination. A proper total resistance for the integral diode and the terminating load is present for all operating currents above a minimum value and, therefore, such structure provides proper matched characteristics over a wide range of operating temperatures.

In a preferred embodiment of the invention, the microwave diode has a N-type conductivity layer of approximately 45 to 55 microns thickness and a resistivity of 6 to 12 ohm-centimeter. The N-type conductivity layer provides the resistance load of the structure and abuts the N+-layer of a PIN diode. The structure is employed with a microstrip multi-throw diode junction and a conductor in contact with the resistance layer is soldered directly to a housing electrically connected to the ground plane of a microwave circuit.

Compared to a diode biased with a small forward current as described, the resistance layer of the proposed device has a relatively large area so that with such arrangement the diode is provided with improved heat sinking characteristics. Consequently, the power handling capability of the device is enhanced because the heat generated in the large area of the resistance layer will not be located in the smaller more confined junction region of the diode but rather in the broader layer region of the device which is thermally connected to the housing of the microstrip circuit to act as a heat sink.

BRIEF DESCRIPTION OF THE DRAWINGS

The above-mentioned and other features of the invention will become more apparent by reference to the following description taken together in conjunction with the accompanying drawings in which:

FIG. 1 is a schematic circuit, somewhat simplified, of the microwave microstrip circuit employing a termination diode of the invention;

FIG. 3 is a plan view of a microstrip circuit and a microwave termination diode according to the invention;

FIG. 4 is a detailed cross-sectional view taken along the line 4—4 in FIG. 3; and FIG. 5 is an exploded isometric view of a packaged embodiment of the invention.

DESCRIPTION OF THE PREFERRED EMBODIMENT

Figure 2A:
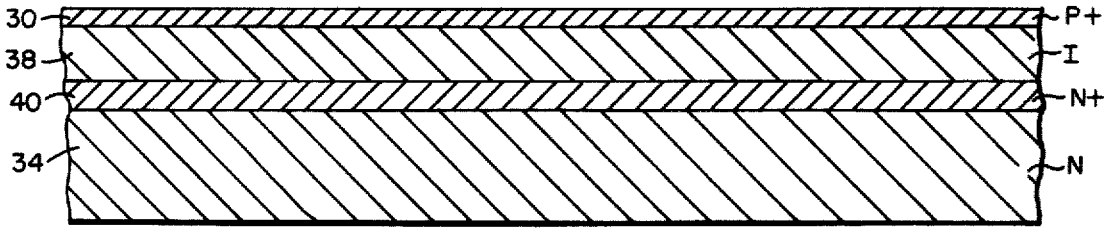
FIGS. 2A–2C are drawings, greatly simplified, useful in understanding the process of making a PIN microwave termination diode body of the invention in wafer form.

Referring now to FIG. 1, a schematic of the circuit incorporating a monolithic device 10, including a microwave diode 11 and integrally formed load resistance 13, is shown in the port branch 12 leading to ground 14. A multi-throw diode junction 16 having a plurality of diodes 18 and 22 in a microstrip configuration has branches 24, 26 and 28 interconnected, respectively, to desired microwave components such as a transmitter, receiver and matched termination device 10 over input branch 26. A small current on diodes 18 or 22 will result in the switching of the energy to either of the two remaining branches in the operation sequence desired for performance in the propagation of the microwave signals. When either 18 or 22 are off, the signals are terminated in a matched load comprising the monolithic device 10. When biased by a small current, the resistance is provided integrally within the monolithic device by means of a layer of an appropriate material formed on a semiconductor wafer which is appropriately diced to form the device. Here the resistance of the resistor 13 is 50 ohms and the impedance of each of the microwave branches 24, 26 and 28 is 50 ohms.

Figure 2B:
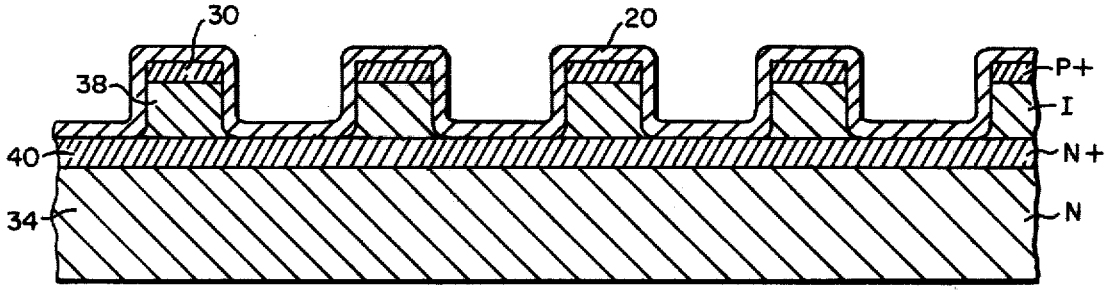
Figure 2C:
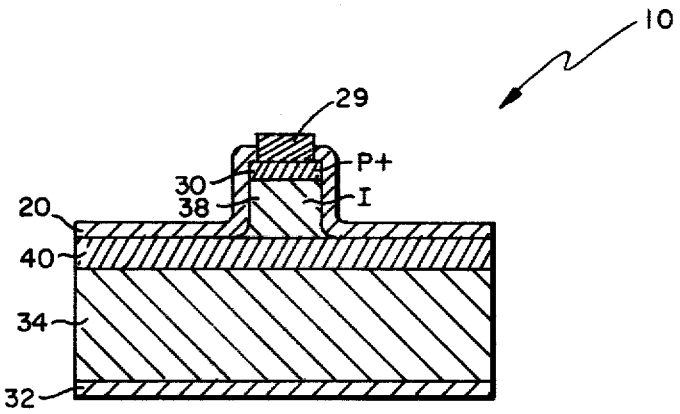

Referring next to FIGS. 2A–2C, the composition of the monolithic microwave device 10 will now be described. A wafer substrate 38 of a silicon material having an intrinsic characteristic has a resistivity of 1000–2000 ohms, a diameter of 1½ inches and a thickness of approximately 250 microns. The crystallographic plane in which the material is oriented is the <111> plane. On one side of the wafer substrate 38 an epitaxially grown layer of N+-type conductivity material having a resistivity of 0.004–0.006 ohm-centimeter and a thickness of 4.5–5.0 microns is formed. The N+-layer is phosphorous doped. Without the N+-layer the space charge within the I-layer would spread to the N-layer. Hence, the N+-layer serves to terminate the spread of the space charge to, illustratively, the N-type conductivity material.

In accordance with the invention, a substantially high fixed resistance of an approximate value of 50 ohms in the forward biased state is provided by a layer 34 to form an integral monolithic structure. A material, such as silicon, doped with, illustratively, type V material, such as phosphorous, forms a layer 34 having a thickness of 45–55 microns and resistivity value of 6–12 ohm-centimeters to provide a resistance value of 50 ohms. Still higher resistances can be achieved by the addition of the thickness of the epitaxially grown silicon layer to yield values of 100 ohms–500 ohms. The intrinsic substrate wafer 38 is lapped and etched and a diffused layer 30 of a P+-type conductivity material having a thickness of approximately 2 microns and a doping material, such as boron is deposited to complete the P-I-N diode incorporating the high fixed resistance having an approximate value of 50 ohms.

A formula for determining the approximate dimensions of the N-layer of resistance material consists of the following:

$R = pl/A$; where $R$ = total resistance in ohms; $l$ = thickness of the material in microns; $p$ = resistivity of the material in ohms-centimeter; and A cross-section of the N-layer in microns$^2$ or centimeters$^2$ depending on the units selected in the equation.

It is a relatively simplified task to grow the fixed resistance N-layer 34 to achieve the desired matched termination load characteristics for operation of the monolithic microwave device in microstrip, stripline, coaxial or waveguide circuits. After completion of the substrate wafer having the P+, N+ and N-layers, a mesa-shaped portion is provided at multiple sites in the wafer comprising the P+ and I sections by means of a suitable hydrofluoric and nitric acid solutions used to etch away the portions of layers 30 and 38. A plurality of such mesas are formed on the substrate with the diameter of each such structure being approximately 3 microns in diameter. After the formation of the mesas, a passivating layer 20 of a material such as silicon dioxide is deposited over the entire wafer.

Upon completion of the formation of the mesas, metallized layers are deposited by evaporation and photolithographic processes to delineate the contact areas for conductors for circuit interconnections and heat sink operations. A layer of chrome is first deposited followed by a layer of gold or other suitable metal to define the metallized conductors 29 and 32. The substrate is diced into a plurality of square sections having an area of approximately 144–225 mils$^2$. Therefore, here the resistance R provided by the structure, R is 50 ohms because $p = 10$ ohms-cm, $l = 50$ microns, and $A = 155$ mils$^2$.

Referring to FIGS. 3 and 4, the monolithic device 10 is positioned in a hole 42 formed in a dielectric substrate 44 having a ground plane 46. The bottom plate 48 of a suitable conductive housing abuts and is electrically connected to the ground plane 46. A ribbon lead 50, here gold, shown in FIG. 4, interconnects electrically the monolithic device 10 to the strip conductor of the microstrip circuit of the multi-throw diode device 16. The impedance of the microstrip circuit is here 50 ohms and is, therefore, matched to the resistance of the resistance layer 34.

The connection of the termination microwave diode, as shown in FIG. 4, is here to a metallized conductor 29 provided adjacent to the P+-layer 30 in the circular mesa-shaped portion of the microwave diode. A bottom metallized conductor 32 adjacent to the resistance layer of N-type conductivity material 34 abuts the ground plane 46 and acts as a heat sink with the housing plate 48 to provide for stabilization of temperature and removal of heat as shown in FIG. 4.

Referring to FIG. 5, a packaged variety of the invention is shown. Such embodiments are adaptable for stripline, coaxial and waveguide circuits. In this embodiment a ceramic cylinder 52 has adjacent one end a metal end plate 54 including a stud portion 56 for insertion of the device in a hole or socket in a circuit. The end plate 54 is sealed to the cylinder 52 by a conventional ceramic to metal metallizing and brazing technique.

The device 10 here has conductor 32 electrically connected to and secured to plate 54 by soldering or brazing techniques. Here two conductors 60 are attached to conductor 29 of device 10 and a previously metallized area 64 along an end edge of cylinder 52. Where desired for electrical operation a single conductor 60 or large number of conductors 60 may be employed. After conductors 60 have been secured to the metallized area 64, a metallic end plate 66 is secured to cylinder 52 to hermetically seal and complete the overall packaged version.

While said microwave termination diode has been illustrated as a P+-I-N+ configuration, often referred to as a P-I-N microwave diode, such devices may be considered of a general class, including N-I-P microwave diodes. Having thus described a preferred embodiment of the invention, it is now evident that other embodiments incorporating these teachings may be practiced. It is felt, therefore, that this invention should not be restricted to the disclosed embodiment but rather should be limited only by the spirit and scope of the appended claims.

What is claimed is:

1. A microwave circuit comprising:

(a) a microwave transmission line having a predetermined impedance, such transmission line comprising a strip conductor and a ground plane conductor separated by a dielectric; and (b) a monolithic semiconductor body comprising:

(i) a diode having a pair of semiconductor layers of opposite conductivity type; and (ii) a resistive layer disposed adjacent one of the pair of layers, said resistive layer having a resistance matched to the predetermined impedance of the transmission line, said diode and resistive layer being serially connected to the strip conductor and the ground plane conductor, the resistive layer being disposed adjacent the ground plane conductor.

* * * * *